US011377935B2

(12) United States Patent
Austin, II et al.

(10) Patent No.: US 11,377,935 B2
(45) Date of Patent: Jul. 5, 2022

(54) UNIVERSAL INITIATOR AND PACKAGING

(71) Applicant: Schlumberger Technology Corporation, Sugar Land, TX (US)

(72) Inventors: David Austin, II, Rosharon, TX (US); Kenneth Goodman, Richmond, TX (US); Allyn Pratt, Meadows Place, TX (US); Pedro Alejandro Hernandez Lopez, Grande Prairie (CA); Joseph George, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 217 days.

(21) Appl. No.: 16/021,061

(22) Filed: Jun. 28, 2018

(65) Prior Publication Data

US 2019/0292887 A1 Sep. 26, 2019

Related U.S. Application Data

(60) Provisional application No. 62/648,129, filed on Mar. 26, 2018.

(51) Int. Cl.

| | |
|---|---|
| ***E21B 43/1185*** | (2006.01) |
| ***F42D 1/05*** | (2006.01) |
| ***F42B 3/26*** | (2006.01) |
| ***E21B 43/117*** | (2006.01) |

(52) U.S. Cl.

CPC ..... *E21B 43/1185* (2013.01); *E21B 43/117* (2013.01); *F42B 3/26* (2013.01); *F42D 1/05* (2013.01)

(58) Field of Classification Search

CPC . F42D 1/04; F42D 1/042; F42D 1/043; F42D 1/045; F42D 1/05; E21B 17/028; E21B 43/1185; E21B 23/04; E21B 29/02; F42B 3/12; F42B 3/121; F42B 3/125; F42B 3/13; F42B 3/26

See application file for complete search history.

(56) References Cited

U.S. PATENT DOCUMENTS

| | | | |
|---|---|---|---|
| 2,062,974 | A | 12/1936 | Lane |
| 2,252,270 | A | 8/1941 | Miller |
| 3,173,992 | A | 3/1965 | Boop |
| 3,836,843 | A | 9/1974 | Yonce |
| 4,004,643 | A | 1/1977 | Newman |
| 4,191,265 | A | 3/1980 | Bosse-Platiere |
| 4,296,481 | A | 10/1981 | Weiss |

(Continued)

FOREIGN PATENT DOCUMENTS

| | | |
|---|---|---|
| CA | 2532088 C | 1/2005 |
| CA | 3044516 A1 | 7/2018 |

(Continued)

OTHER PUBLICATIONS

Exam Report issued in the related CA Application 2892378 dated Nov. 15, 2019, 4 pages.

(Continued)

*Primary Examiner* — Kenneth L Thompson
(74) *Attorney, Agent, or Firm* — Rodney Warfford

(57) ABSTRACT

A wellbore perforating system including a multi-component universal initiator. The universal initiator is a "plug and play" initiator able to accommodate a wide range of perforating gun system.

19 Claims, 10 Drawing Sheets

(56) References Cited

U.S. PATENT DOCUMENTS

| | | | | |
|---|---|---|---|---|
| 4,519,313 | A | 5/1985 | Leidel | |
| 4,619,333 | A | 10/1986 | George | |
| 4,759,291 | A | 7/1988 | Barker et al. | |
| 4,850,438 | A | 7/1989 | Regalbuto | |
| 4,909,320 | A | 3/1990 | Hebert et al. | |
| 5,007,486 | A | 4/1991 | Ricles | |
| 5,756,926 | A * | 5/1998 | Bonbrake | F42D 1/05 102/206 |
| 6,082,265 | A * | 7/2000 | Sakamoto | F42B 3/121 102/206 |
| 6,311,621 | B1 * | 11/2001 | Marshall | H05K 5/0204 102/202.5 |
| 6,412,338 | B2 | 7/2002 | Boyle et al. | |
| 6,412,388 | B1 | 7/2002 | Frazier | |
| 6,412,415 | B1 | 7/2002 | Kothari et al. | |
| 6,655,289 | B1 * | 12/2003 | Bornheim | F42B 3/121 102/202.11 |
| 6,752,083 | B1 * | 6/2004 | Lerche | E21B 43/1185 102/202.5 |
| 7,347,278 | B2 | 3/2008 | Lerche et al. | |
| 7,762,331 | B2 | 7/2010 | Goodman et al. | |
| 8,056,632 | B2 | 11/2011 | Goodman | |
| 8,113,119 | B2 | 2/2012 | Crawford | |
| 8,256,337 | B2 | 9/2012 | Hill et al. | |
| 8,408,132 | B2 * | 4/2013 | Lucas | F42D 1/05 102/202.7 |
| 8,596,378 | B2 | 12/2013 | Mason et al. | |
| 8,943,943 | B2 | 2/2015 | Tassaroli | |
| 9,115,572 | B1 | 8/2015 | Hardesty et al. | |
| 9,494,021 | B2 | 11/2016 | Parks et al. | |
| 9,581,422 | B2 | 2/2017 | Preiss et al. | |
| 9,605,937 | B2 | 3/2017 | Eitschberger et al. | |
| 9,702,680 | B2 | 7/2017 | Parks et al. | |
| 9,903,185 | B2 | 2/2018 | Ursi et al. | |
| 10,188,990 | B2 | 1/2019 | Burmeister et al. | |
| 10,190,398 | B2 * | 1/2019 | Goodman | F42D 1/05 |
| 10,273,788 | B2 * | 4/2019 | Bradley | F42B 5/035 |
| 10,338,030 | B2 | 7/2019 | Bittar et al. | |
| 10,458,213 | B1 | 10/2019 | Eitschberger et al. | |
| 2004/0216866 | A1 | 11/2004 | Barlow et al. | |
| 2005/0211467 | A1 | 9/2005 | Ratanasirigulchia et al. | |
| 2009/0151589 | A1 | 6/2009 | Henderson et al. | |
| 2009/0159285 | A1 | 6/2009 | Goodman | |
| 2010/0005992 | A1 | 1/2010 | Crawford | |
| 2010/0011945 | A1 | 1/2010 | Loehr | |
| 2010/0024674 | A1 * | 2/2010 | Peeters | F42D 1/043 102/275.4 |
| 2011/0024116 | A1 | 2/2011 | McCann et al. | |
| 2012/0018157 | A1 | 1/2012 | Gill et al. | |
| 2012/0138286 | A1 | 6/2012 | Mason et al. | |
| 2012/0152542 | A1 | 6/2012 | Le | |
| 2012/0180678 | A1 | 7/2012 | Kneisl | |
| 2012/0199352 | A1 | 8/2012 | Lanclos et al. | |
| 2012/0247769 | A1 * | 10/2012 | Schacherer | E21B 43/117 166/297 |
| 2012/0247771 | A1 * | 10/2012 | Black | E21B 43/1185 166/297 |
| 2013/0043074 | A1 | 2/2013 | Tassaroli | |
| 2013/0048376 | A1 | 2/2013 | Rodgers et al. | |
| 2013/0153205 | A1 | 6/2013 | Borgfeld et al. | |
| 2014/0338552 | A1 * | 11/2014 | Mace | E21B 43/263 102/215 |
| 2015/0330192 | A1 | 11/2015 | Rogman et al. | |
| 2016/0168961 | A1 | 6/2016 | Parks et al. | |
| 2016/0356132 | A1 | 12/2016 | Burmeister et al. | |
| 2017/0052011 | A1 | 2/2017 | Parks et al. | |
| 2017/0176152 | A1 * | 6/2017 | Goodman | E21B 43/1185 |
| 2017/0211363 | A1 * | 7/2017 | Bradley | F42B 3/08 |
| 2017/0275976 | A1 | 9/2017 | Collins et al. | |
| 2018/0299239 | A1 * | 10/2018 | Eitschberger | F42D 1/045 |
| 2018/0306010 | A1 | 10/2018 | Von Kaenel et al. | |
| 2019/0040722 | A1 | 2/2019 | Yang et al. | |
| 2019/0186241 | A1 | 6/2019 | Yang et al. | |
| 2019/0195054 | A1 * | 6/2019 | Bradley | E21B 43/116 |
| 2019/0257181 | A1 * | 8/2019 | Langford | E21B 43/119 |
| 2019/0292887 | A1 | 9/2019 | David et al. | |
| 2019/0353013 | A1 | 11/2019 | Sokolove et al. | |
| 2020/0018139 | A1 | 1/2020 | Eitschberger et al. | |
| 2020/0024934 | A1 | 1/2020 | Eitschberger et al. | |
| 2020/0024935 | A1 | 1/2020 | Eitschberger et al. | |
| 2020/0048996 | A1 * | 2/2020 | Anthony | E21B 43/1185 |
| 2020/0072029 | A1 * | 3/2020 | Anthony | E21B 43/119 |
| 2020/0256167 | A1 | 8/2020 | Gupta et al. | |

FOREIGN PATENT DOCUMENTS

| | | | |
|---|---|---|---|
| CN | 2244095 | Y | 1/1997 |
| CN | 101575965 | A | 11/2009 |
| EP | 0132330 | A2 | 1/1985 |
| EP | 0175439 | A2 | 3/1986 |
| EP | 0601880 | A2 | 6/1994 |
| EP | 0919694 | A2 | 6/1999 |
| EP | 1930541 | A2 | 6/2008 |
| RU | 121054 | U1 | 10/2012 |
| RU | 2561828 | C2 | 9/2015 |
| WO | 2001096807 | A2 | 12/2001 |
| WO | 2012135101 | A2 | 10/2012 |
| WO | 20130180765 | A1 | 12/2013 |
| WO | 2014089194 | A1 | 6/2014 |
| WO | 2014179669 | A1 | 11/2014 |
| WO | 2018026952 | A1 | 2/2018 |
| WO | 2020203342 | A1 | 10/2020 |
| WO | 2020232242 | A1 | 11/2020 |

OTHER PUBLICATIONS

International Search Report and Written Opinion issued in the related PCT application PCT/US2013/073094, dated Mar. 20, 2014 (9 pages).

International Preliminary Report on Patentability issued in the related PCT application PCT/US2013/073094, dated Jun. 9, 2015 (5 pages).

European Search Report issued in the related EP application 13860417.8, dated Feb. 22, 2016 (6 pages).

Communication article 94-3 issued in the related EP application 13860417.8, dated Mar. 9, 2016 (6 pages).

Office action issued in the related CN application 201380062953.4, dated Sep. 1, 2016 (22 pages).

Office action issued in the related RU application 2015126872, dated Aug. 19, 2016 (8 pages).

Decision of Grant issued in the related RU application 2015126872, dated Dec. 1, 2016 (12 pages).

Communication article 94-3 issued in the related EP application 13860417.8, dated Mar. 8, 2017 (6 pages).

International Search Report and Written Opinion issued in the related PCT application PCT/US2014/036541, dated Sep. 12, 2014 (13 pages).

International Preliminary Report on Patentability issued in the related PCT application PCT/US2014/036541, dated Nov. 3, 2015 (09 pages).

Office action issued in the related CN application 201380062953.4, dated Jun. 15, 2017 (20 pages).

Communication article 94-3 issued in the related EP application 13860417.8, dated Jan. 19, 2018 (5 pages).

Office action issued in the related CN application 201380062953.4, dated Feb. 27, 2018 (11 pages).

Office Action issued in the related U.S. Appl. No. 14/888,882 dated May 25, 2018 (36 pages).

Office Action issued in the related U.S. Appl. No. 14/888,882 dated Nov. 2, 2018 (24 pages).

Office Action issued in the related U.S. Appl. No. 14/888,882 dated Nov. 24, 2017 (28 pages).

Office Action issued in the related U.S. Appl. No. 14/888,882 dated Jan. 30, 2020, 26 pages.

Exam Report issued in the related AR Patent Application No. 20140101829 dated Apr. 16, 2020, 5 pages.

Merriam-Webster Dictionary, multiple various definitions for the term “bulkhead”, published in Jan. 2013. (Year: 2013).

(56) References Cited

OTHER PUBLICATIONS

Office Action issued in the related U.S. Appl. No. 14/888,882 dated Apr. 13, 2021, 16 pages.
English translation of Exam Report issued in the related AR Patent Application No. 20140101829, dated Aug. 30, 2021, 2 pages.
Advisory Action issued in U.S. Appl. No. 14/888,882 dated Sep. 21, 2021, 6 pages.
H-2 Perforating System, Titan division, 2019 (1 page).
Titan H2 Perforating Gun System, (2019) 2 pages, Link: https://www.oilfieldtechnology.com/product-news/07022019/hunting-introduces-h-2-perforating-system/.
International Search Report and Written Opinion issued in the PCT Application PCT/US2020/032879, dated Aug. 28, 2020 (10 pages).
International Search Report and Written Opinion issued in the PCT Application PCT/US2020/017262 dated Jun. 19, 2020, 13 pages.
International Preliminary Report on Patentability issued in the PCT Application PCT/US2020/017262 dated Aug. 19, 2021, 11 pages.
International Preliminary Report on Patentability issued in the PCT Application PCT/US2020/032879 dated Nov. 25, 2021, 8 pages.
Office Action issued in the related U.S. Appl. No. 14/888,882 dated Dec. 3, 2021, 16 pages.

* cited by examiner

UNIVERSAL INITIATOR AND PACKAGING

PRIORITY

This application claims priority to U.S. Provisional Application No. 62/648,129 filed Mar. 26, 2018, that is incorporated by reference in its entirety for all purposes.

FIELD OF THE DISCLOSURE

The disclosure relates generally to wellbore operations. Specifically, safer and more reliable downhole perforating systems and methods of use are described.

BACKGROUND OF THE DISCLOSURE

In a typical oil and gas operation, well casing is installed in a borehole drilled into subsurface geologic formations. The well casing prevents uncontrolled migration of subsurface fluids between different well zones, and provides a conduit for installing production tubing in the well. The well casing also facilitates the running and installation of production tools in the well.

It is common practice in the completion of oil and gas wells to perforate the well casing and the surrounding formation to bring a well into production by the downhole detonation of shaped charges, i.e. explosives of high velocity. A gun-assembled body containing a plurality of shaped charges is lowered into a wellbore and positioned opposite the subsurface formation to be perforated. Electrical signals are then passed from a surface location through a wireline to one or more blasting caps located in the gun body, thereby causing detonation of the blasting caps. The exploding blasting caps in turn transfer a detonating wave to a detonator cord which further causes the shaped charges to detonate. The detonated shaped charges form an energetic stream of high pressure gases and high velocity particles which perforates the well casing and the adjacent formation to form channels. The hydrocarbons and/or other fluids trapped in the formation flow into the channels, into the casing through the orifices cut in the casing, and up the casing to the surface for recovery.

Due to the explosive and dangerous nature of shaped charges, great care must be taken to assure safety in assembly and operation of the perforating guns while maintaining their reliability. As such, many industrial improvements have been made to prevent premature ignition before the perforating gun is properly positioned.

For instance, accidental detonation of explosive devices has been avoided by transferring tools to the well site in an unarmed condition. The arming step is then performed at the well site.

Safety regulations have also been enacted to reduce the amount of manual handling of the perforating guns on a drill rig or handling by inexperienced persons. The American Petroleum Institute (API) developed guidelines for safe handling of the explosives, including the suspension of all surface operations during the arming and connection of the gun sting.

Unfortunately, many of the devices that are designed to increase safety and reliability also add new levels of complexity to the perforating gun. This, in turn, increases the risk of human error and handling issues.

Thus, what is needed in the art are methods and devices to improve the safety and reliability of the perforating guns without making the guns or their assembly more complex. Although wellbore perforations are quite successful, even incremental improvements in technology can mean the difference between safe and cost-effective production and unintended surface explosions.

SUMMARY OF THE DISCLOSURE

The present disclosure includes any of the following embodiments in any combination(s) of one or more thereof:

In an embodiment of the present disclosure, a universal initiator for a perforating gun is provided. The initiator comprises an upper module having a detonator and a detonating cord affixed thereto. The initiator further comprises a lower module adapted for engagement of a wiring harness. The initiator further comprises a printed wiring assembly (PWA) between the upper module and the lower module.

In another embodiment of the present disclosure, the initiator comprises a multi-piece housing, a universal adaptor for engaging a loading tube affixed thereto at the downhole end of the housing, and a universal bulkhead at an up-hole end to engage a firing head. The multi-piece housing has an upper and lower module, each module having an inner and outer surface and an up-hole and downhole end, as well as upper and lower covers that attached to the outer surface of the upper and lower module. A detonator is installed during the manufacturing process and affixed to the outer surface of the upper module. A printed wiring assembly is between the upper and lower module. The printed wiring assembly has a least one microprocessor that is connected to the detonator and an RCA connector for connecting the initiator to the firing head.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. Commonly known details may also be omitted for clarity.

DESCRIPTION OF EMBODIMENTS OF THE DISCLOSURE

Figure 1:
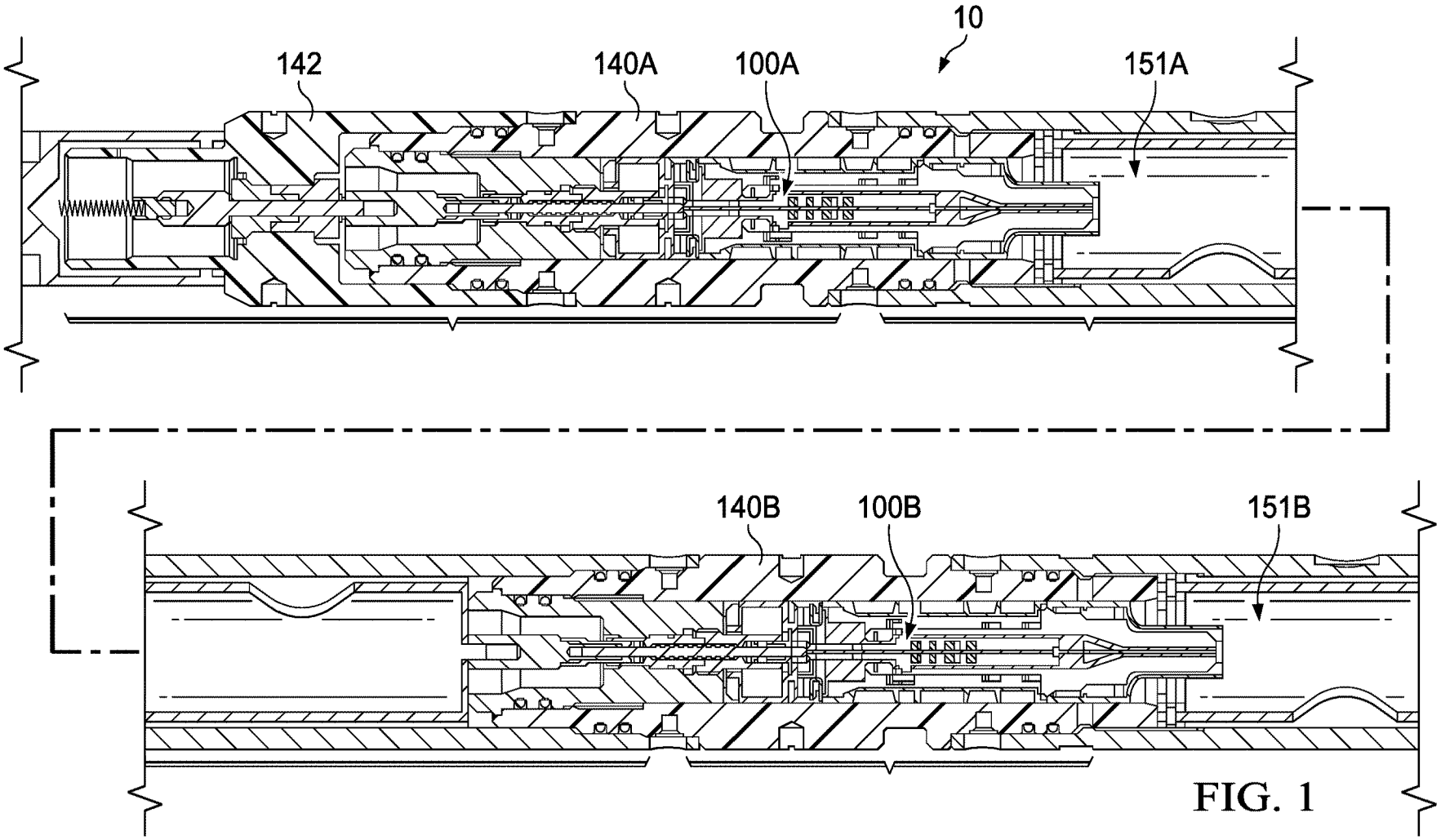
FIG. 1 shows as typical perforating system having an embodiment of the present disclosure installed within.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Further, as used herein, the terms detonator and blasting cap are used interchangeable to refer to the device used to trigger the explosion of the shaped charges. Likewise, "detonating cord" and "blasting cord" are used interchangeably. As used herein, the term "ferrites" refer to ceramics consisting of various metal oxides formulated to have very high permeability. Iron, manganese, manganese zinc (MnZn), and nickel zinc (NiZn) are the most commonly used oxides. A preferred ferrite for the present invention is composed of manganese oxide, zinc oxide and ferric oxide. Ferrites are used to suppress radio frequency (RF) interference and block induced signals from reaching the microprocessor, detonator, and other components mounted on or connected to the printed wiring assembly (PWA). As such, ferrites can be used in a variety of locations on the PWA. For example, ferrite can be located near the inputs or they can be located nearer the detonator connection.

As used herein, the surface command is understood to originate from a surface telemetry system, such as a wireline acquisition system or an off the shelf telemetry system used for downhole perforation operations.

Generally, the invention provides a universal initiator for a wellbore perforation system and methods of using such. The initiator provides features to increase safety, reliability, and ease of use, including a select fire system and simplified connectors.

The present initiator and methods are exemplified with respect to a high shot density perforating gun system using a single perforating gun. However, this is exemplary only, and the invention can be broadly applied to any perforating gun, irrespective of shot density, or a series of guns. Further, the present initiator and method may be used within cased hole or open hole environments and remain within the scope of the present disclosure. The following description and figures are intended to be illustrative only, and not unduly limit the scope of the appended claims.

Disclosed herein is an improved perforating system that uses a universal initiator that has a printed wiring assembly (PWA) that is pre-wired with simplified connectors for quick connection to other parts of a perforating system. Embodiments of the universal initiator comprise universal adaptors on the up-hole and downhole end for easy assembly with other parts of the perforating system. The universal initiator includes a pre-installed detonator with features for engaging a detonating cord in proximity thereto. Additionally, the universal initiator has features to engage the wiring harness for select-fire operations. The universal initiator comprises a multi-piece housing that allows for quick access to the PWA and detonator. These features make the universal initiator a "plug and play" device, i.e. it does not require further reconfiguration or adjustment for use in conventional or select-fire operations and can be used in a wide range of sizes of perforating systems.

The easy attachment ability of both the universal initiator and the wiring reduces general human error, which results in decreased wiring mistakes at the wellbore and/or misruns. Further improvements to the universal initiator include safety features for preventing unintentional detonation and means of securing a detonating cord in proximity to the pre-installed detonator. Such improvements simplify on-site assembly of the system and prevent premature detonation while improving the reliability of the initiator.

FIG. 1 shows a typical perforating system 10 having an embodiment of the present disclosure installed within. As shown, the perforating system 10 comprises multiple universal initiators 100A, 100B engaged to the top end of respective loading tubes 151A, 151B. The universal initiators 100A, 100B are housed within adapters 140A, 140B. The upper adapter 140A having a firing head 142 affixed thereto. The adapters 140A, 140B and the firing head 142 are sized based on the overall size of the perforating system 10. Thus, the universal initiators 100A, 100B can be used for a wide range of perforating gun system sizes by use of varying sized adapters 140A, 140B.

Figure 2:
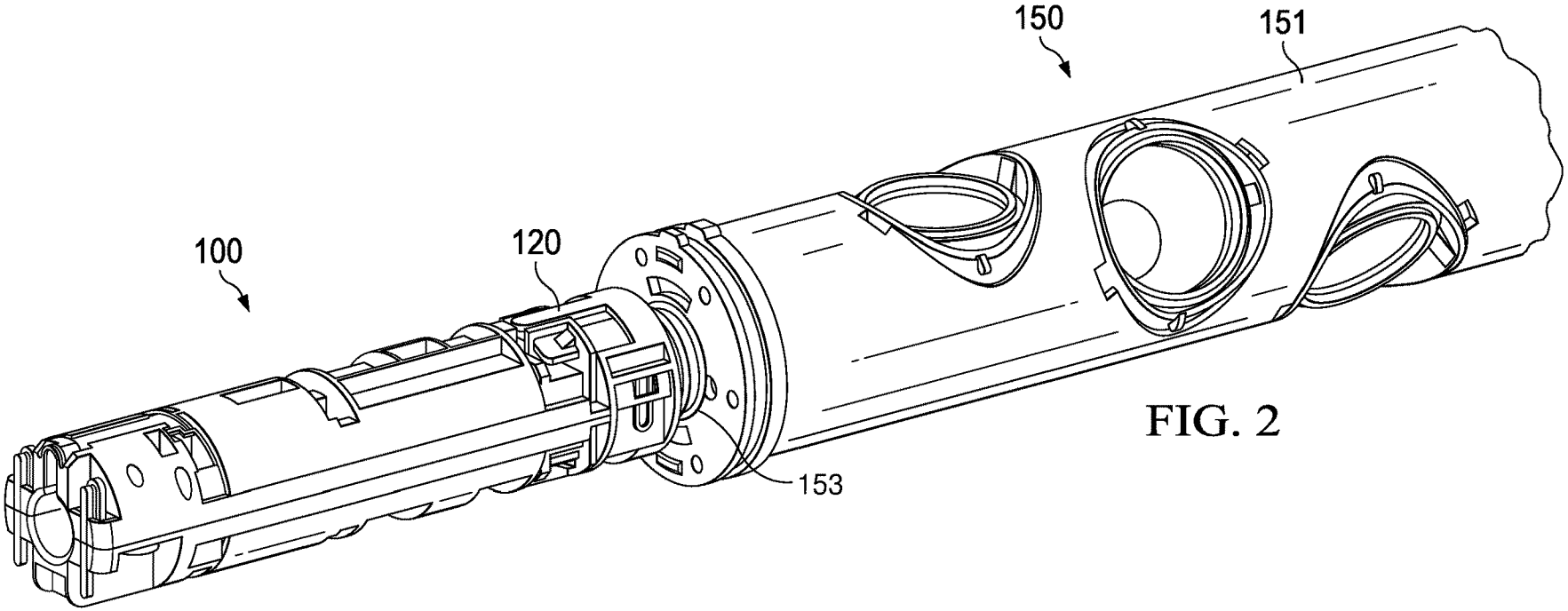
FIG. 2 shows an embodiment of the universal initiator of the present disclosure coupled to a loading tube of a perforating gun.

FIG. 2 shows an embodiment of the universal initiator 100 of the present disclosure coupled to a loading tube 151 of a perforating gun, referred to generally as 150. The initiator 100 is located at the top of the loading tube 151 of the perforating gun 150 and connected thereto using a universal intermediate housing 120. In an embodiment of the present disclosure, the universal intermediate housing 120 is made of plastic but can be made of any suitable material and remain within the purview of the present disclosure. The intermediate housing 120 connects to both the upper alignment plate of the loading tube 151 and the universal initiator 100 itself by means of snap-fit features. In the embodiment of the present disclosure shown, the connection to the loading tube 151 is "floating" on a spring 153 to allow for tolerance stack up error. In an embodiment of the present disclosure, the spring 153 is a coil spring but other types of springs, such as a wave spring, can be used instead of a coil spring. The spring 153 allows the universal initiator 100 to accommodate a wide range of loading tube dimensions.

An embodiment of the universal initiator 100 is described in more detail with reference to FIGS. 3A, 3B, and 3C. As shown, FIG. 3A displays an exploded view of an embodiment of the universal initiator 100, FIG. 3B shows the universal initiator 100 with the upper and lower outer covers 101A, 101B removed, and FIG. 3C shows the fully assembled universal initiator 100.

The shown embodiment of the universal initiator 100 is comprised of an upper outer cover 101A, a lower outer cover 101B, an upper module 103A, a lower module 103B, and a printed wiring assembly (PWA) 104. As will be more fully described with reference to FIGS. 4A and 4B, a conventional blasting cap 102 is housed in the upper module 103A, and as will be more fully described with reference to FIG. 5, the lower module 103B has features for routing gun-wires for select-fire operations.

Figure 3A:
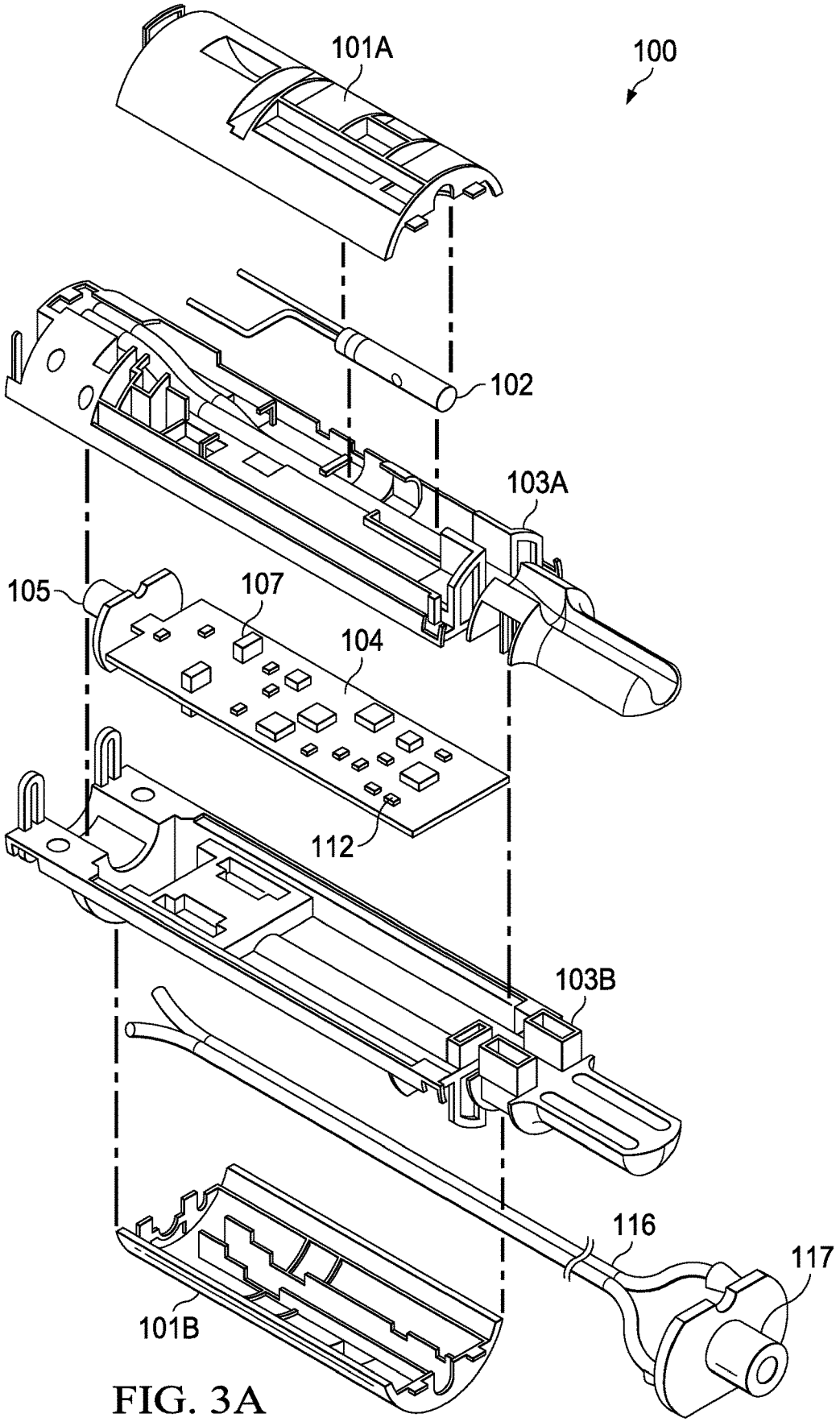
FIG. 3A is an exploded view of one embodiment of the presently disclosed initiator.
Figure 3B:
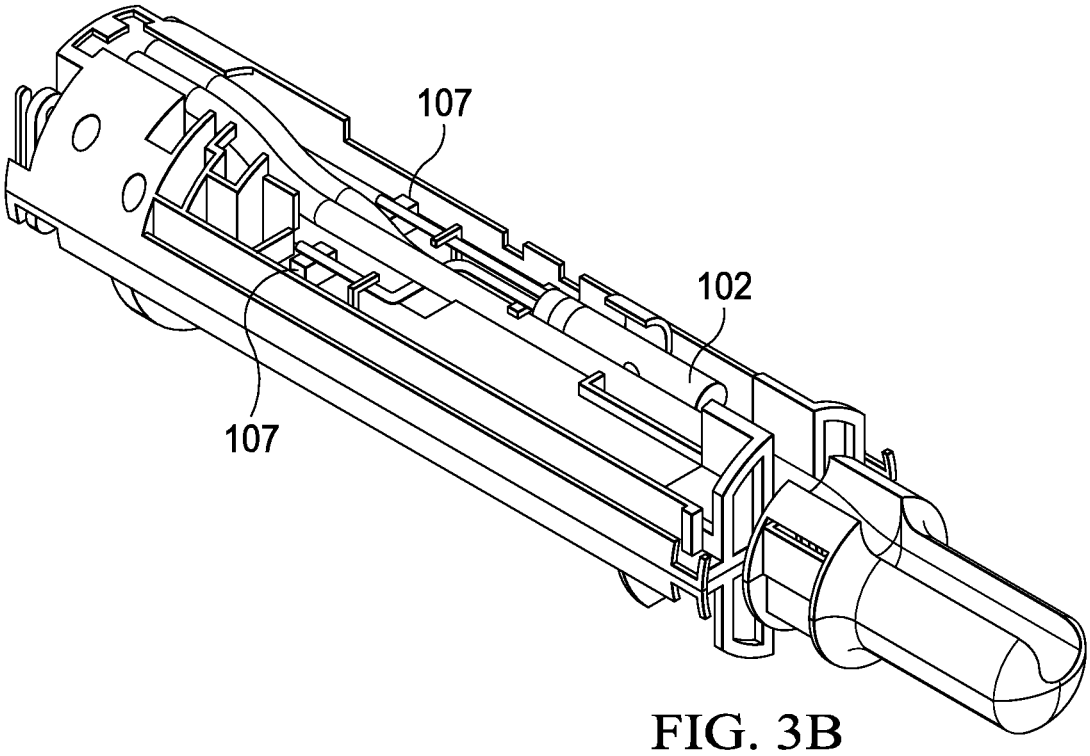
FIG. 3B shows the universal initiator with the upper and lower outer covers removed.
Figure 3C:
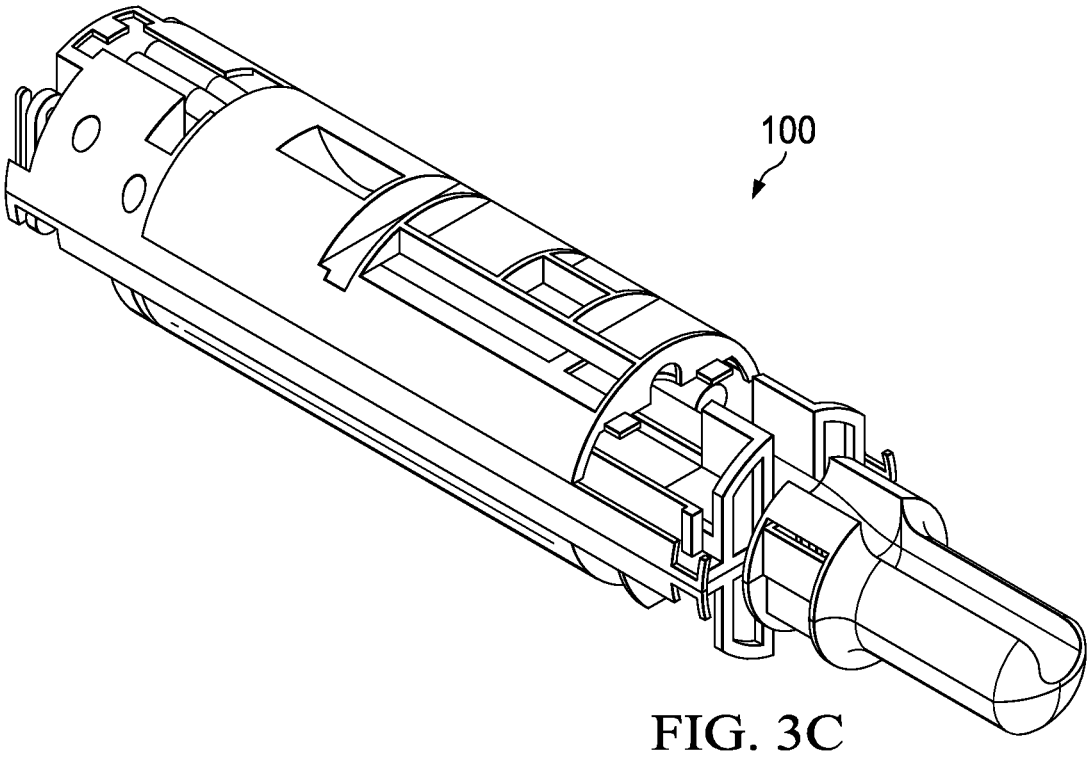
FIG. 3C shows the fully assembled universal initiator.

As best understood with reference to the exploded view of FIG. 3A, splitting the housing of the universal initiator 100 into an upper module 103A and a lower module 103B allows for reliable ballistic transfers and access to electronic features without adding complexity to the initiator 100, and it provides the ability to include, modify, and replace design features such as retaining barbs as needed. Further, in embodiments using injection-molded plastics for the housing and its components lowers the cost of the initiator 100 while allowing the incorporation of conventional ballistics.

Housed between the upper module 103A and the lower module 103B is the PWA 104. The PWA 104 is the heart of the initiator 100 as it establishes the link between the surface communications and the detonator 102, includes many safety mechanisms to prevent unintentional detonation, and accepts RCA and IDC connectors for the initiator's plug-and-play capabilities.

The PWA 104 is housed between the upper and lower modules 103A, 103B by a series of latches or other types of attachments added to the inner surface of either the upper or lower module 103A, 103B to secure the PWA 104 and prevent its movement during transport and deployment. In some embodiments, both the upper and lower modules 103A, 103B have a series of protrusions on the inner surface that sandwich the PWA 104 to maintain its position and prevent movement. As will be more fully discussed below, the upper and lower modules 103A, 103B have openings to allow for wiring and connectors to access the PWA 104.

The PWA 104 of the present disclosure simplifies the design of the initiator 100 while improving its safety. To simplify the design of the electronic system and assembly of the perforation system, the currently described initiator 100 comes with pre-assembled PWA wiring such that simplified connectors can be used to connect the PWA 104 to other parts of the perforating system, such as the detonator 102, loading tubes 151, firing heads 142, and wireline cables. For instance, the PWA 104 is connected to the pre-installed blasting cap detonator 102 during the manufacturing process using insulation-displacement connectors (IDC) 107, removing the need for such connections to be performed at the well site. The PWA 104 can also be connected to an upper gun using an RCA connector 105, and the PWA 104 can be connected to a select-fire loading tube's wiring 116 using an IDC connector 107. The PWA 104 can also connect to a wireline cable by means of an RCA style connector at the up-hole end. Thus, with the attachment of these simplified connectors (IDC and RCA), the PWA 104 provides communication between the surface, detonator 102 and/or loading tube 121, as well as relays status information for the initiator 100 and the perforating gun system itself. This greatly reduces the amount of human attention needed onsite, which adds another layer of safety for the prevention of unintended detonation.

Figure 4A:
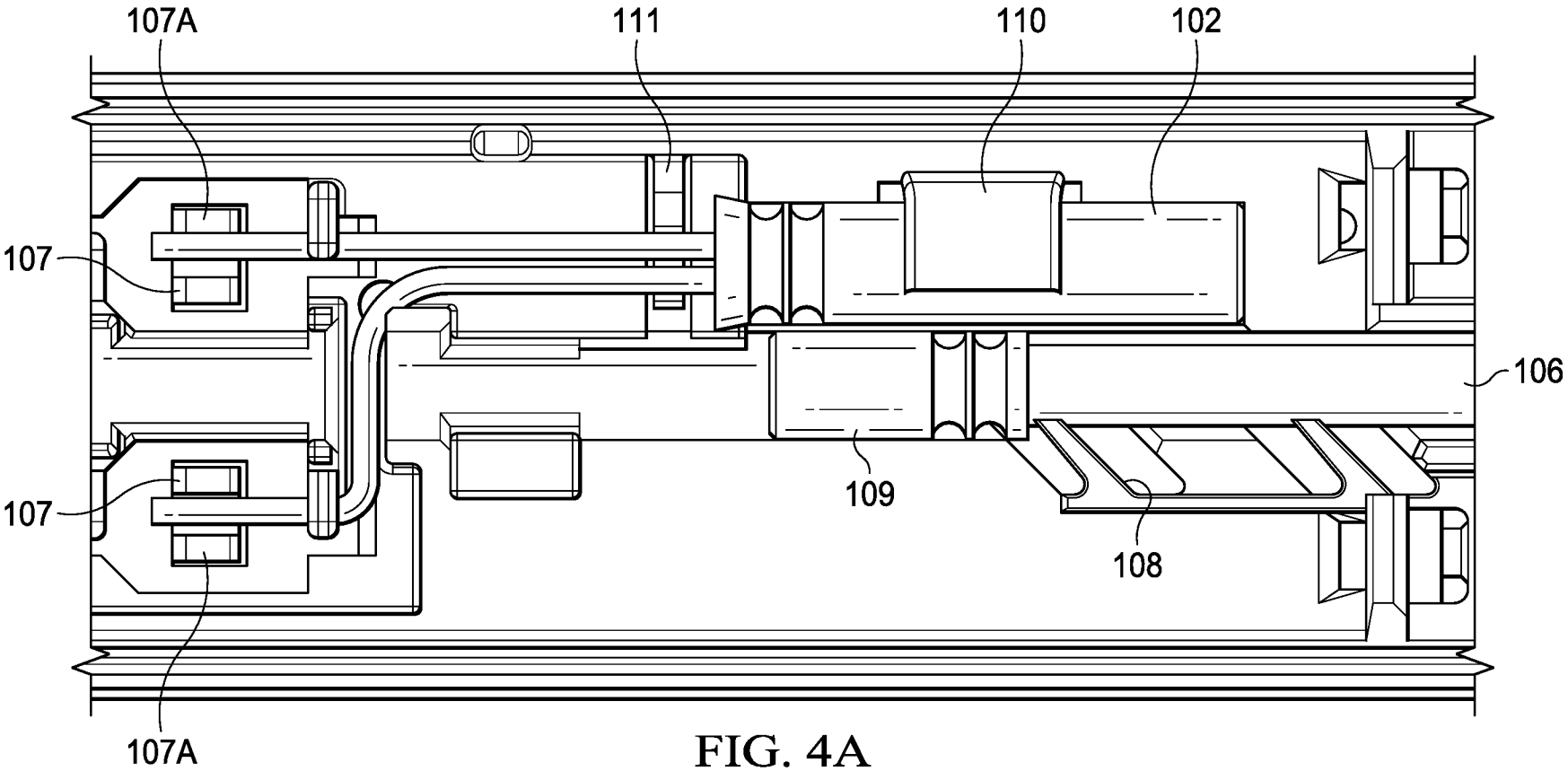
FIG. 4A shows a more detailed view of the portion of the upper module of an embodiment of the present disclosure that includes fasteners or retaining barbs for securing the detonating cord.

The upper module 103A utilizes novel features to house and maintain a conventional detonator or blasting cap 102 near and/or adjacent to a detonating cord used in conjunction with a perforating gun. FIG. 4A shows a more detailed view of the portion of the upper module 103A that includes fasteners or retaining barbs 108 for securing the detonating cord 106 such that it can be installed and held in place near the detonator 102 during deployment.

Figure 4B:
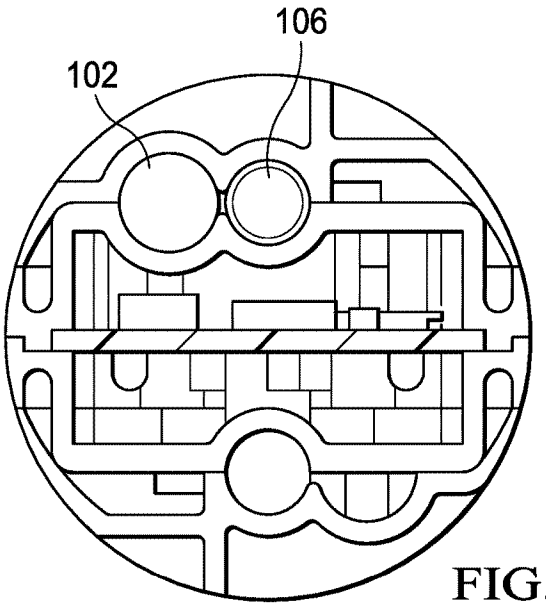
FIG. 4B provides a cross-sectional view of the initiator to show the proximity of the detonator to the detonating cord.

FIG. 4B provides a cross-sectional view of the initiator 100 from up-hole to show the close proximity of the detonator 102 to the detonating cord 106 when installed in the upper module 103A. It should be understood that in embodiments of the present disclosure, any conventional detonating cord 106 known in the art can be used with the present universal initiator 100.

With reference to FIG. 4A, in some embodiments of the presently disclosed initiator 100 a crimp shell 109 is attached to the end of the detonating cord 106 to further secure the detonating cord 106 to the initiator 100 at its predetermined position. A detonating cord 106 is prone to shrinkage at elevated temperatures, and while the fasteners or retaining barbs 108 on the upper module 103A may secure the detonating cord 106 during transportation and/or installations within certain temperature ranges, these features may not be sufficient to overcome the natural shrinkage of the detonating cord 106 at elevated temperatures. Excessive shrinkage of the detonating cord 106 can negatively impact the ballistic transfer during detonation.

The crimp shell 109 is used to counter the negative impact of shrinkage of the detonating cord 106. In the event of shrinkage due to elevated temperature, the retaining barbs 108 catch the crimp shell 109 and prevent the detonating cord 106 from moving away from the detonator 102. In some embodiments, additional features can be included on the inside of the upper outer cover 101A (facing the detonating cord 106 and upper module 103A) when needed to provide additional retention of the detonating cord 106 and/or blasting cap 102.

The upper module 103A also has at least one fastener 110 for affixing the blasting cap 102 installed during the manufacturing process to the outer surface of the upper module 103A. The fastener 110 latches over the detonator 102 and maintains the location of the detonator 102 in close proximity to the detonating cord 106 during perforating gun assembly and wellbore deployment. The fastener 110 further presses the detonator 102 securely against the outer surface of the upper module 103A to prevent movement during transport. A second fastener 111 can also be used at the up-hole end of the detonator 102 to prevent it from moving axially along the initiator 100.

The upper module 103A additionally has 107A openings to allow wires, cables and connectors, such as the IDC connectors 107 shown, to pass through to provide communication between the PWA 104 and the detonator 102. Additionally, the upper module 103A may have fasteners or retaining barbs to secure the communication wiring, cables and connectors.

Embodiments of the lower module 103B of the universal initiator 100 have features for routing and securing wiring to and from the PWA 104 to other parts of the perforating gun system. For example, perforating guns with electronic select-fire loading tubes 151 can utilize a pre-assembled wiring harness 116 that connects to the PWA 104 in the initiator 100 using IDC style connectors 107.

Figure 5:
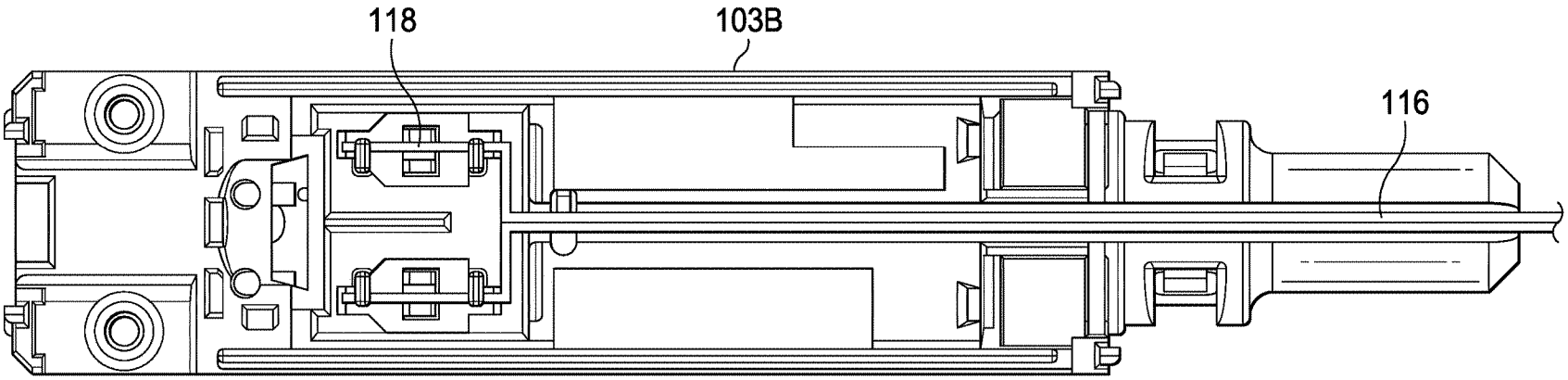
FIG. 5 shows a bottom view of the lower module showing the wiring harness affixed thereto.

FIG. 5 provides a bottom view of the lower module 103B showing the wiring 118 of the wiring harness 116 affixed thereto. As shown, the wires 118 are routed from the PWA 104 and extend beyond the universal initiator 100 for connection to the firing head of the next perforating gun. In an embodiment of the present disclosure, the termination of the wiring harness is an RCA connection 117 (shown in FIG. 3A).

The pre-assembled wiring harness 118, and IDC style connectors 107, along with RCA style connectors 105 on the up-hole end of the PWA 104, eliminate wiring mistakes, inadvertent disconnection of wiring during deployment and system assembly, and the reliability problems associated with alternative electrical connections (e.g. Scotch locks, ground lugs, wire nuts, and the like) typically used by perforating guns, all while greatly simplifying the firing operations or allowing for selective firing operations. Universal wiring harnesses for a given length of a perforating gun can be pre-assembled and utilized to aid in the ability to easily incorporate the initiator 100 into the perforating system. This wiring assembly harness can then be secured to the lower module half 103B using a series of fasteners. In embodiments of the present disclosure, the lower module half 103B can also comprise one or more openings for running wiring therethrough to the PWA 104.

Referring back to FIGS. 3A, 3B, and 3C, upper and lower outer covers 101A, 101B protect the upper and lower modules 103A, 103B, the gun wiring 118, detonator 102, and detonating cord 106. Both covers 101A, 101B can include one or more attachment points for attaching the initiator 100 to an adapter (protective cover) 140 or other pieces of the assembly.

In embodiments of the present disclosure, the multi-piece modular plastic housing (outer covers 101A, 101B and modules 103A, 103B) are injection molded and preferably made out of a thermoplastic with high temperature stability such as polyamide, polyethylene, polyphenylene oxide, polyphenylene sulfide, polypropylene, polyetherimide, polyether ether ketone, polyether sulfone, or polybenzimidazole. However, other thermally stable polymers can be used as well.

Further, the pieces of the modular housing can be reversibly attached using any means known in the art, such as a snap fit. This type of attachment allows for the quick and easy dis-arming of the initiator 100 or access to the electronics (e.g. PWA 104 or connectors 107) housed by the initiator 100. For instance, the upper cover 101A and module 103A may have a series of protrusions that mate with holes on the lower cover 101B and module 103B or vice versa. Alternatively, a hinge can connect the upper and lower covers and/or the upper and lower module such that the pieces can be closed and snapped together at one location. In yet another alternative, the pieces of the modular housing can be molded together to form a single piece and make use of living hinges to form the joints.

The features of the modular housing that retain the various initiator components (e.g. detonator 102, detonating cord 106, wiring 118, PWA 104) can be part of the mold for the modular housing or may be reversibly attached to the modular housing using snap fits or screw fits.

Figure 6:
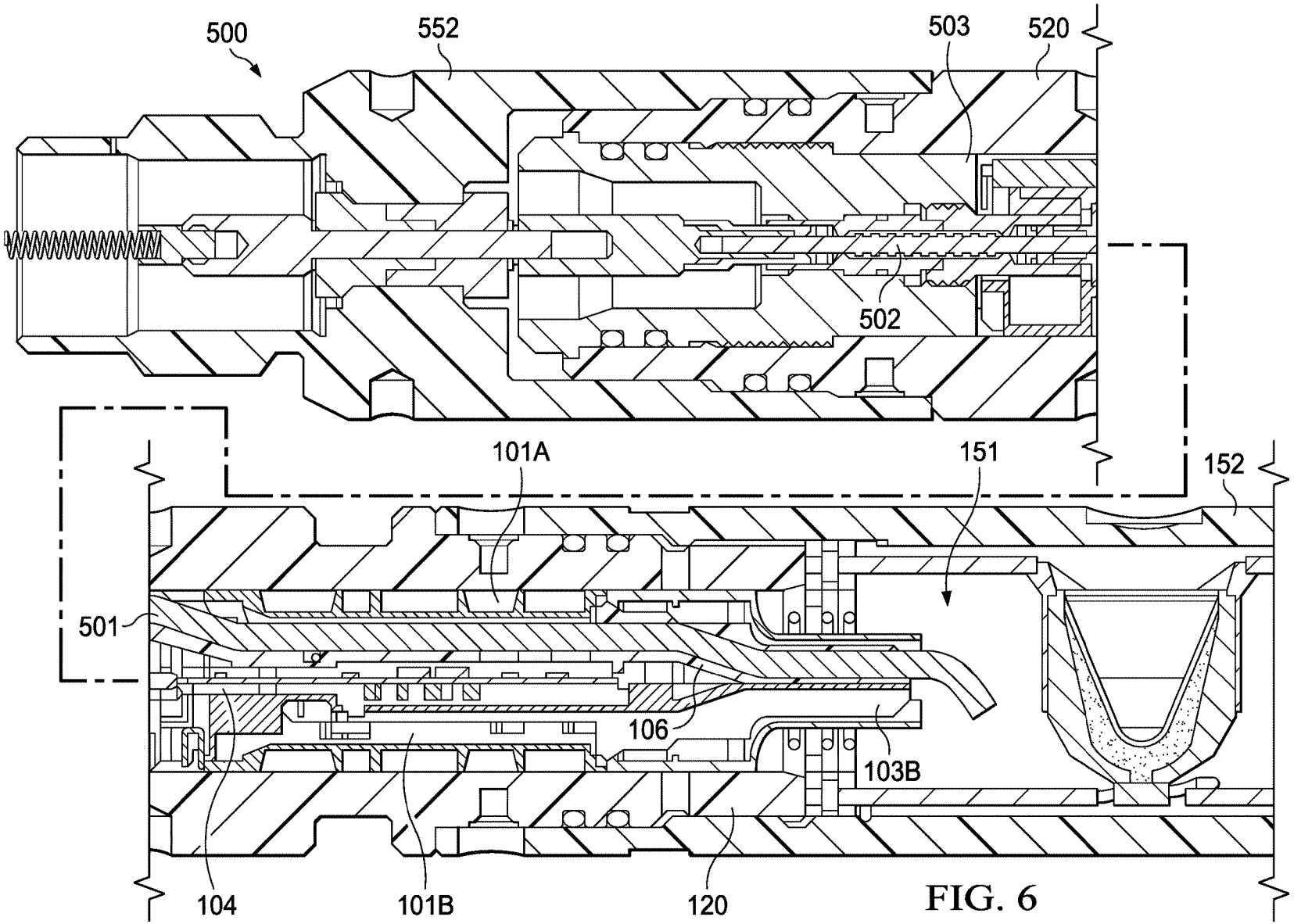
FIG. 6 shows an embodiment of the universal initiator connected to a loading tube and a firing head.

FIG. 6 shows an embodiment of the universal initiator 100 connected to a loading tube 151, loading tube carrier 152 and a firing head 552. As described above, the initiator 100 connects to the loading tube 151 via an intermediate housing 120. At the up-hole end of the initiator 100, electrical connection from the firing head 552, an up-hole gun (not shown), wireline cable (not shown) or other electrical source is made by means of the RCA connector 501 and disposable brass feedthrough 502 housed in a universal bulkhead 503. Universal bulkheads 503 between guns are simple one-wire feed-throughs to simplify the initiator 100. The universal bulkhead 503 enables easy access to the disposable brass feedthrough 502 for replacement, if needed, after each shot. The universal bulkhead 503 is capable of withstanding high temperature and pressures, and it protects the connectors (e.g. 501) from exposure from wellbore fluids.

FIG. 6 also shows the adapter, or protective covering, 520 for the initiator 100. This protective covering 520 protects the initiator 100 and its components from exposure to wellbore fluids and enables the initiator 100 to accommodate many sizes and combinations of loading tubes 151, carriers 152, and perforating gun systems. The protective covering 520 itself may include one or more retaining tabs sized and shaped to mate with corresponding holes or recesses on the firing head 552 and loading tube 151 or loading tube carrier 152 to ensure proper alignment of the initiator 100 in the loading tube 151 or loading tube carrier 152. Alternatively, threaded type connections can be used to connect the protective covering 520 and firing head 552 or loading tube 151 or loading tube carrier 152 This simple firing head 552 and adapter 520 design reduces the total cost of ownership of the initiator 100 while improving the reliability of the system.

In addition to the features that improve the 'plug and play' ability of the initiator 100, in embodiments of the present disclosure, the PWA 104 may also include a number of mechanisms for preventing unintended detonation, including an addressable-switch firing system (ASFS) and ferrite beads.

ASFS technologies, which use a series of microprocessors on the PWA 104 to operationally check and arm a digital switch for each detonator, are readily incorporated into the presently disclosed initiator 100. The PWA 104 has at least one microprocessor controlled electronic switch associated with the pre-installed detonator 102. Each electronic switch has a unique address that will have to be positively identified by a command originating from the surface prior to activating the initiator 100, and the unique address must be confirmed by the microprocessor to arm the initiator 100. This two-way communication and confirmation between the PWA 104 and the surface is required to shoot any gun, which limits unintended detonation.

The PWA 104 also has one or more passive ferrite components 112 (shown in FIG. 3A) as another means to prevent unintended detonation. Passive ferrite components suppress high frequency noise by converting it to a negligible amount of heat and will impart a high level of RF safety to the current initiator 100. They also block induced signals from reaching the microprocessor, detonator, and other components mounted on or connected to the PWA 104. The addition of ferrite components on the PWA is less complicated and more reliable than the Electronic Foil Initiator (EFI) design.

The PWA 104 has at least one ferrite bead adjacent to each input to suppress radio frequency interference and at least one ferrite bead near the detonator 102. Ferrite is a passive electric component that prevents interference both to the PWA 104 and from the PWA 104. This, in turn, adds an additional level of safety as it limits unintended detonation due to stray RF frequencies. Iron, manganese, manganese zinc (MnZn), and nickel zinc (NiZn) are the most commonly used ferrite oxides. A preferred ferrite for the present invention is composed of manganese oxide, zinc oxide and ferric oxide. Ferrite beads are also preferred as they are capable of being mounted directed to the PWA 104. However, other ferrite shapes such as cores or rings can be used. In addition to being mounted on the PWA 104, ferrite can be mounted on the ends of any wire or cable attached to the PWA 104 as an added level of safety.

Finally, embodiments of the initiator 100 also eliminate pressure bleed ports. In previously designed perforating systems, o-rings have been a source of reliability problems. By eliminating the pressure bleed ports and reducing the number of o-rings, the reliability of the initiator 100 can be improved.

Thus, the initiator 100 provides top tier features (addressability, selectivity, and RF immunity) using conventional blasting cap detonators and injection molded plastic housings in place of the more expensive to manufacture EFI style detonator. As the assembly of the entire initiator 100, including installation of the detonator 102, occurs at the manufacturer, this improves reliability of the initiator 100 by eliminating miswiring mistakes at the wellsite, improving ballistic transfer, and reducing unintentional detonation.

The initiator 100 further includes a number of attachment points on its upper and lower modules 103A, 103B to snap-fit adapters used to couple the initiator 100 to the loading tube, wireline, firing head or another perforating system.

In an ASFS application, once connected, the perforating gun with the described initiator 100 can be conveyed downhole via wireline. At this point, the initiator 100 is not operational in the sense that it is unable to signal the detonator 102. Rather, the initiator 100 is only able to receive communication from the surface and send status updates for the system.

Upon reaching the desired downhole depth, a unique, specific command can be transmitted from the surface system power source to the initiator 100 to activate an ASFS. As mentioned above, each electronic switch for the blasting cap 102 has a unique address that must be positively identified prior to shooting. Once the specific command for the intended switch is received and the unique address is confirmed by the microprocessors on the PWA 104, the system is armed and activated. At this point, an electric current is able to pass through the electronics and initiate the explosive blasting cap 102. The blasting cap 102 detonates, transferring ballistically to the detonating cord 106, and then from the detonating cord 106 to each successive shaped charge of the perforating gun. The explosively formed jet of the gun's shaped charges perforate the wellbore casing and cement and then penetrate deep into the reservoir formation, allowing trapped fluids to flow freely into the wellbore and be communicated to surface.

Embodiments of the universal initiator 100 of the present disclosure allow for a quick and easy attachment of the initiator 100 to the remaining pieces of the perforating systems at the location of the wellbore. These quick connections remove many of the human errors experienced with the typically on-site assembly of perforating systems and reduce the risk of mis-wiring the initiator 100 to the system.

Further, the safety mechanisms in the currently described initiator 100 are simple additions to the device and do not unduly complicate the system or its assembly.

Additionally, by pre-arming the initiator 100 in manufacturing with a detonator 102 and splitting the plastic confinement (upper and lower outer covers 101A, 101B and upper and lower modules 103A, 103B), the initiator 100 has a more reliable ballistic transfer. The housing as well as novel design features also simplify the gun-arming process, which decreases the risk of unintended detonation or an inability to detonate.

Similarly, dis-arming the initiator 100 is also simplified and does not require any additional cutting or crimping of the detonating cord 106. Rather, the disarming signal can be sent to the PWA 104 while it is downhole, and the detonator 102 can be removed once the device is at the surface by simply removing the upper outer cover 101A then separating the initiator 100 from the loading tube 151 and loading tube carrier 152 and/or interface plastics.

Figure 7A:
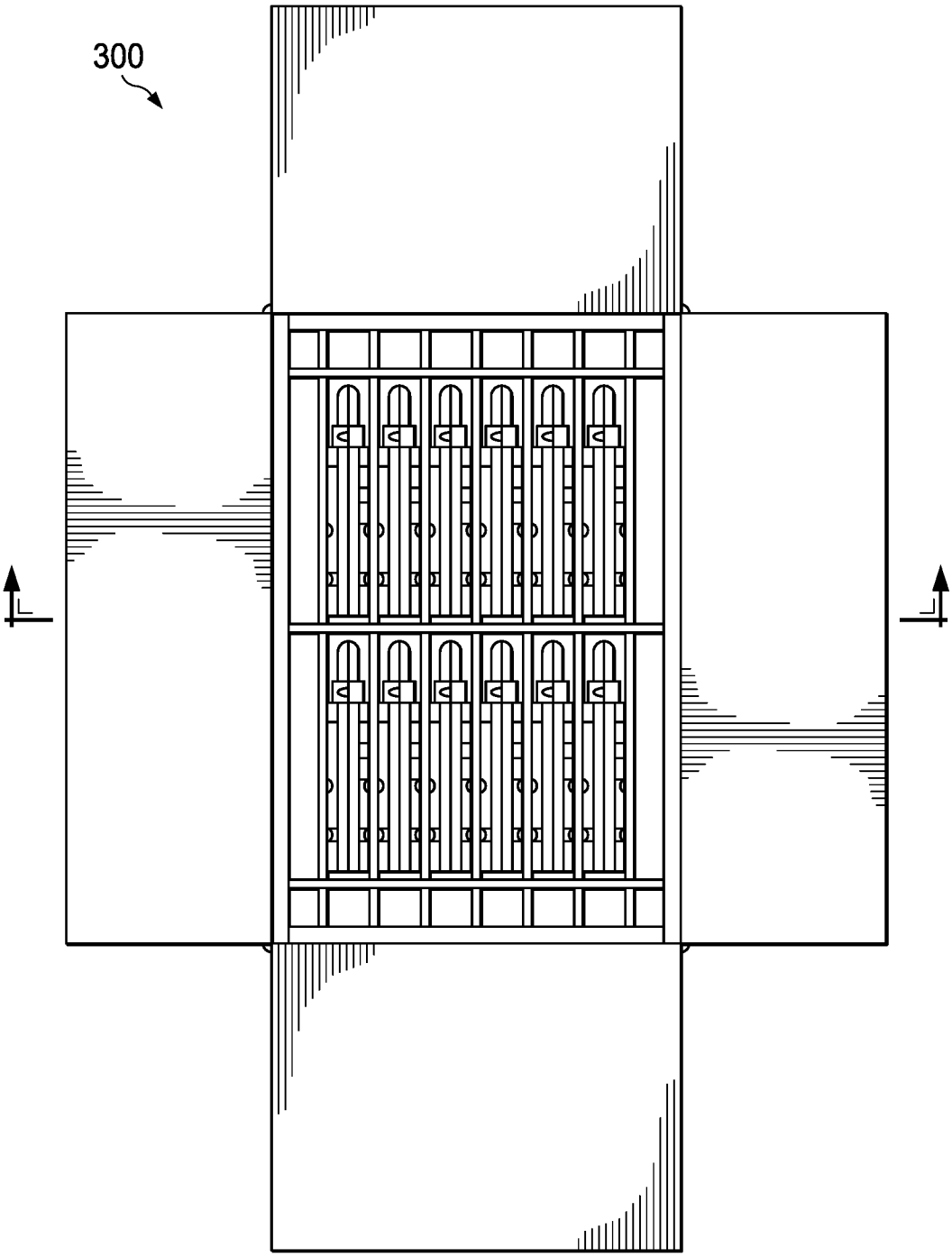
FIG. 7A is a top view of packaging for a case of twenty-four initiators.
Figure 7A:
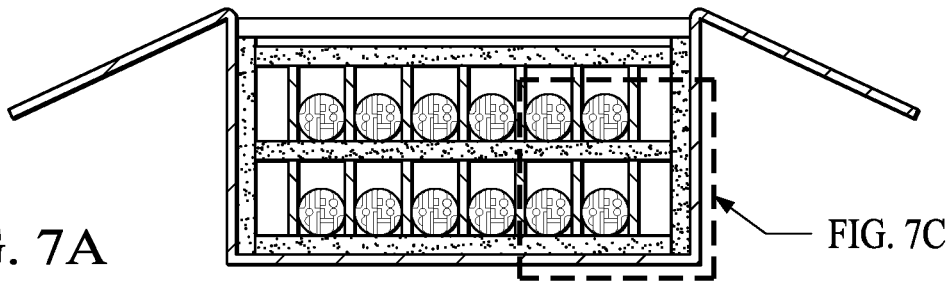
Figure 7B:
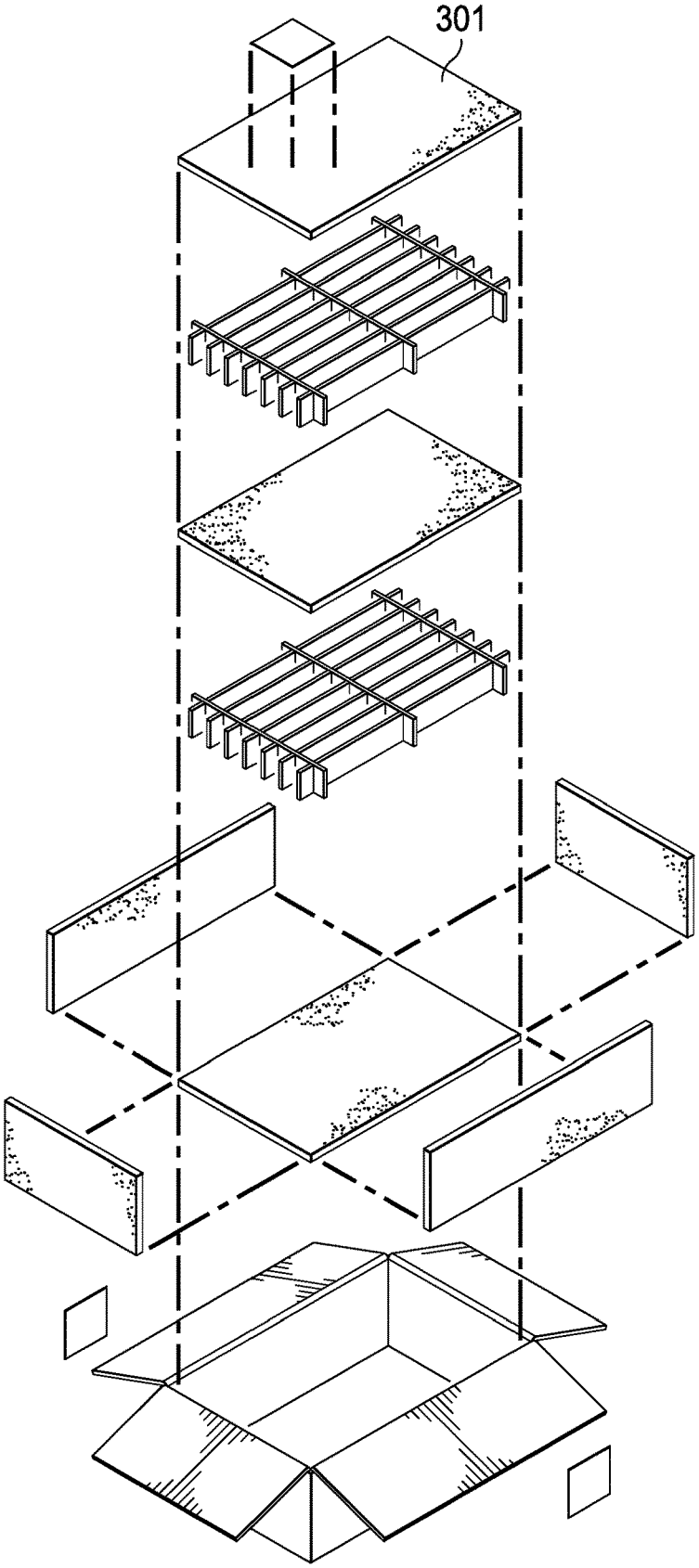
FIG. 7B is an exploded view of the packaging and partitions.

To overcome issues related to transport of the initiator 100 with a preinstalled detonator 102 from the manufacturing site to the wellbore site, the initiators 100 are packaged and shipped in a fiberboard box 300 in a specific orientation. In one embodiment shown in FIG. 7A, twenty-four (24) initiators are packaged in a single UN 4G fiberboard box 300, which is a heavy duty, double walled box. Additional fiberboard pads and dividers 301, shown in FIG. 7B, are used to satisfy the regulations of Title 49 Code of Federal Regulations as issued by the U.S. Department of Transportation (DOT) and classified per UN Explosive Hazard Classification Systems as Class 1.4s (DOT Reference #EX2017030549). This hazard classification allows for transportation of the initiator via both cargo and commercial aircraft.

Figure 7C:
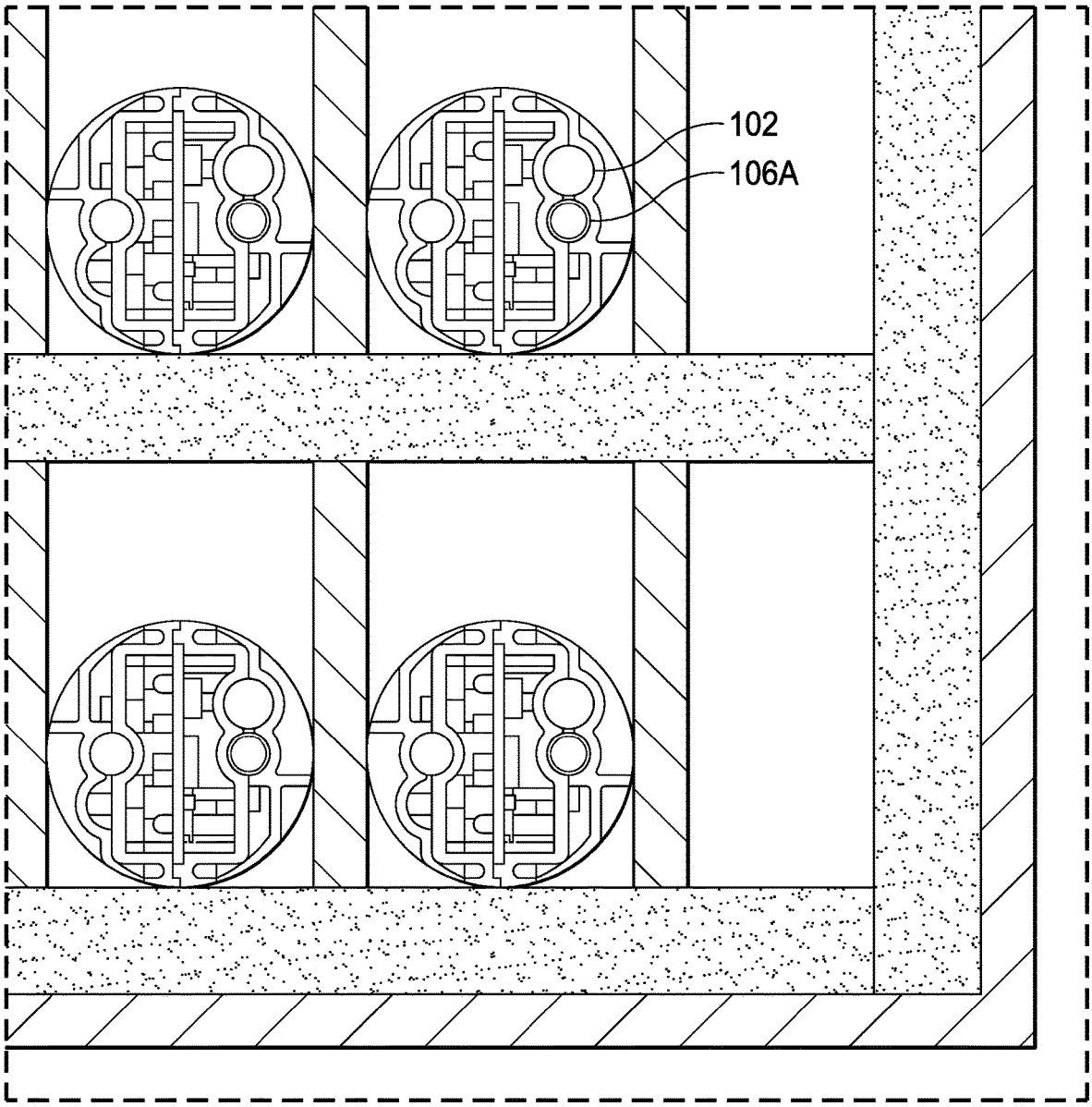
FIG. 7C is a cut away of the side view of FIG. 7A showing the orientation of the detonator in the initiators.

The initiators 100 themselves are all oriented in the same position in a partition tray, with the blasting cap 102 in the twelve (12) o'clock position, vertically above the detonating cord channel 106A per FIG. 7C. This described orientation adds a layer of procedural control, particularly for US DOT classification assessment. However, other orientations can be utilized.

While the foregoing is directed to embodiments of the present invention, other and further embodiments of the invention can be devised without departing from the basic scope thereof, and the scope thereof is determined by the claims that follow.

The invention claimed is:

1. An initiator for a perforating gun comprising:

an upper module having a detonator and a detonating cord affixed thereto;

a lower module adapted for engagement of a wiring harness, wherein the upper module and lower module are connectable along a longitudinal axis of the lower and upper modules; and a printed wiring assembly (PWA) between the upper module and the lower module.

2. The initiator of claim 1, further comprising an intermediate housing for engaging a loading tube of the perforating gun.

3. The initiator of claim 2, wherein the intermediate housing is in floating engagement with the loading tube by use of a coil spring.

4. The initiator of claim 1, wherein the PWA has at least one ferrite bead.

5. The initiator of claim 1, wherein the PWA has an RCA connector near its up-hole end.

6. The initiator of claim 1, wherein the PWA is connected to the detonator through an Insulation Displacement Connector (IDC) connection.

7. The initiator of claim 1, wherein the PWA is connected to the wiring harness through an IDC connection.

8. The initiator of claim 1, wherein the upper and lower modules are made from thermoplastic materials.

9. The initiator of claim 1, wherein the PWA further comprises an addressable switch microprocessor.

10. An initiator for a perforating gun comprising:

a multi-piece housing comprising an upper and lower module, each module having an inner and outer surface and an up-hole and downhole end, the multi-piece housing further comprising an upper and lower cover, wherein the upper cover attaches to the outer surface of the upper module and the lower cover attaches to the outer surface of the lower module;

a detonator affixed to the outer surface of the upper module;

a printed wiring assembly (PWA) between the upper and lower modules, wherein the PWA has a least one microprocessor that is connected to the detonator; and a universal adaptor at a downhole end of the multi-piece housing, wherein the universal adaptor connects to a loading tube; and a universal bulkhead at an up-hole end of the multi-piece housing, wherein the universal bulkhead connects to a firing head.

11. The initiator according to claim 10, further comprising an RCA connector on the PWA that connects to a brass feedthrough in the universal bulkhead.

12. The initiator according to claim 10, wherein the universal adaptor has an opening adapted for receiving and securing of a detonating cord.

13. The initiator according to claim 12, wherein the outer surface of the upper module further comprises a first location for the detonating cord and a series of barbs for retaining the detonating cord, wherein said first location is adjacent to the detonator.

14. The initiator according to claim 10, wherein the universal adaptor comprises a spring such that said initiator floats on the loading tube to allow for tolerance stack up error.

15. The initiator according to claim 10, wherein the PWA has at least one ferrite bead.

16. The initiator according to claim 15, wherein the ferrite is selected from a group comprising manganese oxide, zinc oxide and ferric oxide.

17. The initiator according to claim 10, wherein the PWA is connected to the detonator using an insulation-displacement connector style connector.

18. The initiator according to claim 10, wherein the multi-piece housing is a thermoplastic.

19. The initiator according to claim 18, wherein the thermoplastic is selected from a group comprising polyamide, polyethylene, polyphenylene oxide, polyphenylene sulfide, polypropylene, polyetherimide, polyetherether ketone, polyether sulfone, polybenzimidazole or combinations thereof.

* * * * *